US005194899A

United States Patent [19]

Buchanan

[11] Patent Number: 5,194,899

[45] Date of Patent: Mar. 16, 1993

[54] COMPLEX PAGE BIT MAP COMPOSITION

[75] Inventor: James C. Buchanan, Lexington, Ky.

[73] Assignee: Lexmark International, Inc., Greenwich, Conn.

[21] Appl. No.: 856,614

[22] Filed: Mar. 24, 1992

[51] Int. Cl.[5] ..... G03G 15/04

[52] U.S. Cl. ..... 355/244; 355/271; 355/326; 358/448; 358/450; 395/147; 395/148

[58] Field of Search ..... 355/272, 244, 326, 327, 355/208, 271, 232, 218; 358/448, 450, 75, 80; 346/157, 160; 395/147-148

[56] References Cited

U.S. PATENT DOCUMENTS

| | | | |
|---|---|---|---|
| 3,991,405 | 11/1976 | Boyd et al. | 340/172.5 |
| 4,195,927 | 4/1980 | Fotland et al. . | |
| 4,899,196 | 2/1990 | Mahoney | 355/271 |
| 5,018,023 | 5/1991 | Kubota | 358/450 |
| 5,018,883 | 5/1991 | Fujita | 400/211 |
| 5,032,853 | 7/1991 | van Stiphout et al. | 346/157 |
| 5,052,835 | 10/1991 | Takahashi | 400/279 |
| 5,084,831 | 1/1992 | Montawa et al. | 395/116 |
| 5,086,434 | 2/1992 | Abe et al. | 375/7 |
| 5,086,497 | 2/1992 | Horikawa et al. | 395/147 |
| 5,089,859 | 2/1992 | Kusumoto et al. | 355/327 |
| 5,089,901 | 2/1992 | Kaneko | 358/474 |

*Primary Examiner*—A. T. Grimley
*Assistant Examiner*—T. A. Dang
*Attorney, Agent, or Firm*—John A. Brady

[57] ABSTRACT

Segments of a full page are composed by data processing apparatus (13) of a printer (1) and separately transferred to intermediate roller (7). When all of the segments of a page are applied to the intermediate roller, the page is transferred to final paper (14) and output from the printer Memory and timing requirements are reduced for composition of complex pages.

2 Claims, 2 Drawing Sheets

COMPLEX PAGE BIT MAP COMPOSITION

TECHNICAL FIELD

This invention relates to the printing of pages by dot matrix from data received in any page description language. A page description language is a formal set of codes used to describe a complex page having text, graphics, and embellishment such as borders and background designs. Considerable computing resources, in computer capacity and computing time or in both, is generally required to compose such an image received in a page description language into bit mapped form. This invention is directed to composing such an image in a manner reducing the computing resources.

BACKGROUND OF THE INVENTION

Some existing printers have the capability to store an image on an intermediate medium from which the image will be transferred and to accurately register that intermediate medium for repetitive imaging before transfer of the final image. This capability is employed, for example, to make up a color image by forming three color images on the intermediate medium in three separate steps, after which the complete color image is transferred to paper or other final medium to receive the image.

This invention takes advantage of such capability of the printing art to accurately register images on an intermediate medium. In accordance with this invention, partial images of a page are composed and transferred to the intermediate medium and that is repeated for the remaining parts of the page, thereby requiring less computing resources. U.S. Pat. Nos. 4,899,196 to Mahoney and 4,195,927 to Fotland et al illustrate printing using such an intermediate image-receiving member, but not to compose a page by segments.

DISCLOSURE OF THE INVENTION

Memory and timing requirements for page bit map composition are reduced by sequentially composing and then imaging contiguous final-size segments of a full image on an image-retaining member. The full final-size image is transferred to the output paper (or other final medium) after the full image is formed on the image-retaining member.

BRIEF DESCRIPTION OF THE DRAWING

The details of this invention will be described in connection with the accompanying drawing, in which.

BEST MODE FOR CARRYING OUT THE INVENTION

Figure 1:
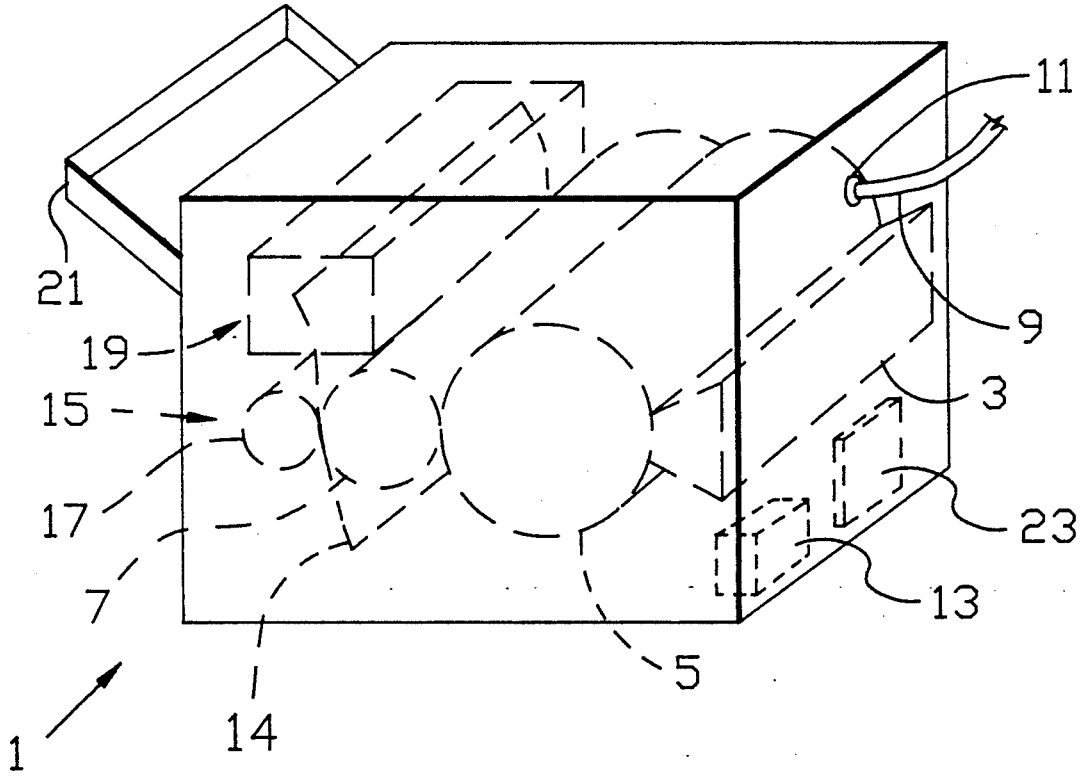
FIG. 1 is illustrative of a printer with data processing means and an intermediate image receiving member.

FIG. 1 is illustrative of a printer 1 having dot matrix imaging means 3, which in this preferred embodiment employs electrophotography comprising a conventional photoconductive drum 5 since such images may be transferred to an intermediate member 7. Member 7 is a roller in contact with the length of drum 5. Images described in a page description language are received as coded, electrical signals on a transmission cable 9 at printer terminal 11. Electronic data processing apparatus 13, specifically a standard microprocessor, contains interpreter software, which may also be conventional, to transform signals in the page description language to which the interpreter responds into bit images which define the separate, contiguous areas or bits to be made either light or dark by imaging means 3. Such bit image printing by electrophotographic technology is now conventional.

In accordance with this invention, intermediate roller 7 is imaged in segments corresponding to a fraction of a page, prior to transfer to the final paper or other substrate 14 at transfer stage 15. Transfer stage 15 is shown illustratively with a backup roller 17, and may in practice be a conventional transfer stage. The image transferred to paper 14 is then fixed, typically by heat, at fixing station 19 and delivered to an output tray 21 for human access and use. Memory 23 is employed by data processing apparatus 13.

Figure 2:
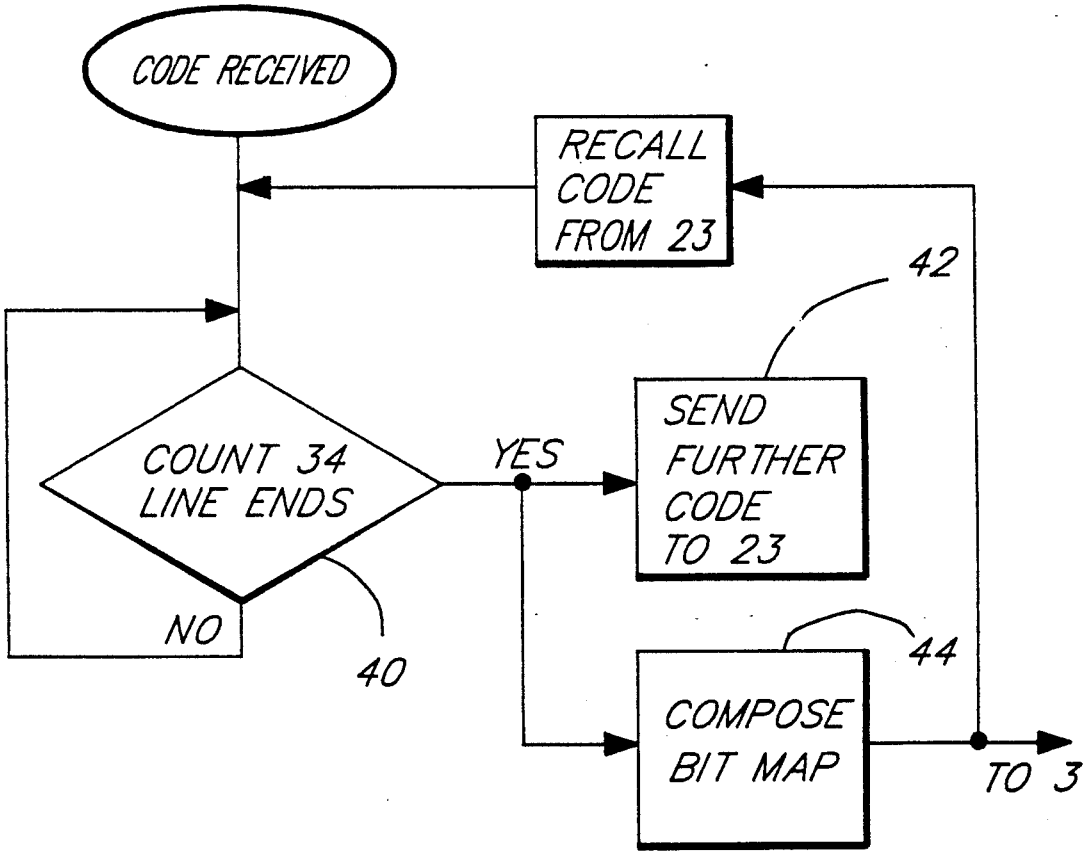
FIG. 2 is a sequence diagram by which the data processing is implemented in the preferred embodiment.

System control by data processing apparatus 13 is illustrated in FIG. 2. The page description language received is searched for line ending designators in action 40, which constitute codes in which a line ending necessarily occurs, such a skip codes, as well as explicit line ending codes. In this preferred embodiment the page will be divided into two segments, corresponding to the top vertical half and the bottom vertical half, with printed lines being horizontal. When action 40 determines that 34 lines have been received, remaining code received is sent to buffer memory 23 in action 42, and the half page is composed in action 44, and then transferred to imaging means 3, which images that one half page as an unfixed, final-size image on intermediate member 7. Intermediate member 7 then holds that one half page as an unfixed image until the second segment of the page is imaged on it.

Immediately after transfer of the top half of the page to imaging means 3, action 46 recalls any page description language information in the buffer memory 23 to action 40, which begins a new count for 34 line ends. After buffer 23 is empty of page description information, information is received directly from cable 9. Such information is received by action 40 until action 40 by counting lines endings, establishes the next 34 lines. Subsequent page description information is sent to buffer memory 23 by action 29 and the bottom half page is composed in action 44, then transferred to imaging means 3, where the other half of the page is imaged on intermediate member 7 contiguous to and in registration with the first half so that member 7 then contains the full final-size page an unfixed image. Immediately thereafter, the full image is transferred at stage 15 to the paper 14, which is fixed at stage 19 and then output as the final document in tray 21.

Subsequent information received is processed and imaged in the same way. This invention reduces the requirement for data processing resources to compose a full page, thereby reducing costs, faults and timing constraints. It will be clear that the invention applies to any page description language which can be interpreted to bit mapped images and to any imaging technology in which an intermediate image can be stored and enlarged in segments. Page information effecting more than one segment can be stored in memory and referenced by data processing apparatus 13 to compose each affected segment. The page can be composed and transferred to intermediate roller 7 in any number of horizontal segments, preferably selected as the least number needed to process the data received in view of the speed of receipt and the data processing capabilities of the printer.

What is claimed is:

1. A printer comprising data processing apparatus to compose bit mapped images of segments of a page to be printed received by said printer in electronic code, said data processing apparatus creating said composed segments as information received between codes in said page image which are characteristic of line endings image forming means to form a final-size image of each of said segments from each said bit mapped images of said segments, an image receiving member, means to transfer said final-sized image of each of said segments to said image receiving member sequentially as said segments are composed in registration to form an unfixed, final-size image of said page on said image receiving member, and means to transfer said page image from said image receiving member to a surface in visual form.

2. The printer as in claim 1 in which said data processing apparatus creates said comprised segments as information received between a predetermined number of said codes which are characteristic of line endings.

* * * * *

UNITED STATES PATENT AND TRADEMARK OFFICE

CERTIFICATE OF CORRECTION

PATENT NO. : 5,194,899

DATED : March 16, 1993

INVENTOR(S) : James C. Buchanan

It is certified that error appears in the above-identified patent and that said Letters Patent is hereby corrected as shown below:

Column 1, line 42 after "contiguous" insert -- , --.
Column 1, line 43 after "full" insert -- , --.
Column 2, line 50 after "full" insert -- , --.
Column 2, line 50 after "page" insert -- as --.
Column 3, line 9 after "endings" insert -- , --.
Column 4, line 8 delete "comprised" and insert -- composed --.

Signed and Sealed this

Twelfth Day of April, 1994

Bruce Lehman

*Attest:*

BRUCE LEHMAN

*Commissioner of Patents and Trademarks*

*Attesting Officer*